US011807824B1

(12) United States Patent
Taylor

(10) Patent No.: US 11,807,824 B1
(45) Date of Patent: Nov. 7, 2023

(54) FUEL ADDITIVE COMPOSITION

(71) Applicant: Clifton Ray Taylor, Houston, TX (US)

(72) Inventor: Clifton Ray Taylor, Houston, TX (US)

( * ) Notice: Subject to any disclaimer, the term of this patent is extended or adjusted under 35 U.S.C. 154(b) by 0 days.

(21) Appl. No.: 18/162,536

(22) Filed: Jan. 31, 2023

Related U.S. Application Data

(60) Provisional application No. 63/412,725, filed on Oct. 3, 2022.

(51) Int. Cl.

| | |
|---|---|
| ***C10L 1/232*** | (2006.01) |
| ***C10L 1/222*** | (2006.01) |
| ***C10L 1/20*** | (2006.01) |
| ***C10L 1/182*** | (2006.01) |

(52) U.S. Cl.
CPC ..... *C10L 1/2225* (2013.01); *C10L 1/182* (2013.01); *C10L 1/203* (2013.01); *C10L 1/232* (2013.01); *C10L 2200/0254* (2013.01); *C10L 2200/0259* (2013.01); *C10L 2200/0407* (2013.01); *C10L 2300/30* (2013.01)

(58) Field of Classification Search
CPC ..... C10L 1/2225; C10L 1/182; C10L 1/203; C10L 1/232; C10L 2200/0254; C10L 2200/0259; C10L 2200/0407; C10L 2300/30
USPC ..... 585/4
See application file for complete search history.

(56) References Cited

U.S. PATENT DOCUMENTS

| | | | | |
|---|---|---|---|---|
| 2005/0044778 | A1 | 3/2005 | Orr | |
| 2014/0378547 | A1* | 12/2014 | Zielinski | A61P 1/02 514/570 |
| 2023/0116584 | A1* | 4/2023 | Farmer | A23K 10/18 426/2 |

FOREIGN PATENT DOCUMENTS

| | | | |
|---|---|---|---|
| CN | 1869169 | A | 11/2006 |
| CN | 102304395 | A | 1/2012 |
| CN | 103980960 | A | 8/2014 |
| CN | 103450957 | B | 12/2014 |
| CN | 103421552 | B | 6/2015 |
| CN | 106221820 | A | 12/2016 |
| CN | 108102746 | A | 6/2018 |

(Continued)

OTHER PUBLICATIONS

"Soltron Enzyme Fuel Additive/Stabilizer", https://www.fisheriessupply.com/soltron-soltron-enzyme-fuel-additive-stabilizer, Apr. 17, 2013.

(Continued)

*Primary Examiner* — Prem C Singh
*Assistant Examiner* — Francis C Campanell
(74) *Attorney, Agent, or Firm* — Marco H. Santamaria; Justin R. Jackson; Peacock Law P.C.

(57) ABSTRACT

A fuel additive composition comprising an anthocyanidin; an amino acid; and a catalyst. The anthocyanidin may comprise delphinidin chloride. The amino acid may comprise aspartic acid, leucine acid, glutamic acid, a non-natural amino acid, or a combination thereof. Embodiments of the present invention also relate to a method for making of fuel additive, the method comprising: providing an anthocyanidin; contacting the anthocyanidin with an amino acid to form an anthocyanidin-amino acid mixture; contacting the anthocyanidin-amino acid mixture with a catalyst. The method may further comprise contacting the anthocyanidin-amino acid mixture with ethanol and/or an acid. The method may further comprise adjusting the pH of the anthocyanidin-amino acid mixture to less than 7.

20 Claims, 10 Drawing Sheets

| Table 1: Vehicle emission results from an all-terrain vehicle with 87 octane fuel without a fuel additive. | | | |
|---|---|---|---|
| $O_2$ | 12.0 % | $T_A$ | 91.7 °F |
| $CO_2$ | 6.6 % | $T_S$ | 352.4 °F |
| SL | 17.3 % | $E_{fc}$ | 82.7 % |
| CO | 0.0 ppm | Pr | 1.016 $in_{WC}$ |
| $CO_c$ | 0.0 ppm | EA | 133 % |
| $D_{pt}$ | 106.8 °F | GI | 0.0 |
| $NO_X$ | 28.0 ppm | $NO_{Xc}$ | 65 ppm |

(56) References Cited

FOREIGN PATENT DOCUMENTS

| | | | |
|---|---|---|---|
| CN | 109082311 | A | 12/2018 |
| CN | 113481036 | A | 10/2021 |
| EP | 0460006 | B1 | 5/1993 |
| KR | 100390973 | | 1/2012 |

OTHER PUBLICATIONS

"Star Tron Enzyme Fuel Treatment—Classic Gas Formula", http://www.starbrite.com/item/star-tron-gasoline-additive, Jun. 7, 2013.

* cited by examiner

| Table 1: Vehicle emission results from an all-terrain vehicle with 87 octane fuel without a fuel additive. | | | |
|---|---|---|---|
| $O_2$ | 12.0 % | $T_A$ | 91.7 °F |
| $CO_2$ | 6.6 % | $T_S$ | 352.4 °F |
| SL | 17.3 % | $E_{fc}$ | 82.7 % |
| CO | 0.0 ppm | Pr | 1.016 $in_{WC}$ |
| $CO_c$ | 0.0 ppm | EA | 133 % |
| $D_{pt}$ | 106.8 °F | GI | 0.0 |
| $NO_X$ | 28.0 ppm | $NO_{Xc}$ | 65 ppm |

Fig. 1

| Table 2: Vehicle emission results from an all-terrain vehicle with 87 octane fuel without a fuel additive. | | | |
|---|---|---|---|
| $CO_c$ | 0.0 ppm | EA | 131 % |
| $D_{pt}$ | 107.0 °F | GI | 0.0 |
| $NO_X$ | 28 ppm | $NO_{Xc}$ | 65 ppm |
| NO | 28 ppm | $NO_c$ | 65 ppm |
| $NO_2$ | 0.0 ppm | $NO_{2c}$ | 0.0 ppm |
| $SO_2$ | 125 ppm °F | $SO_{2c}$ | 289 ppm |
| $C_{on}$ | 0.0 ppm | | |

Fig. 2

| Table 3: Vehicle emission results from an all-terrain vehicle with 87 octane fuel with a fuel additive. | | | |
|---|---|---|---|
| $O_2$ | 19.7 % | $T_A$ | 89.7 °F |
| $CO_2$ | 1.0 % | $T_S$ | 114.0 °F |
| SL | 12.8 % | $E_{fc}$ | 87.2 % |
| CO | 0.0 ppm | Pr | - 0.009 $in_{WC}$ |
| $CO_c$ | 0.0 ppm | EA | 1515 % |
| $D_{pt}$ | 77.3 °F | GI | 0.0 |
| $NO_X$ | 6.0 ppm | $NO_{Xc}$ | 97 ppm |

Fig. 3

| Table 4: Vehicle emission results from an all-terrain vehicle with 87 octane fuel with a fuel additive. | | | |
|---|---|---|---|
| $CO_c$ | 0.0 ppm | EA | 1515 % |
| $D_{pt}$ | 77.3 °F | GI | 0.0 |
| $NO_X$ | 6.0 ppm | $NO_{Xc}$ | 97 ppm |
| NO | 6.0 ppm | $NO_c$ | 97 ppm |
| $NO_2$ | 0.0 ppm | $NO_{2c}$ | 0.0 ppm |
| $SO_2$ | 19 ppm | $SO_{2c}$ | 307 ppm |
| $C_{on}$ | 0.0 lbs/lb | | |

Fig. 4

| Table 5: Vehicle emission results comparison from an all-terrain vehicle with 87 octane fuel without vs. without a fuel additive. | | | |
|---|---|---|---|
| $O_2$ Diff. | - 7.7 % | $T_A$ Diff. | 2 °F |
| $CO_2$ Diff. | 5.6 % | $T_S$ Diff. | 238.4 °F |
| SL Diff. | 4.5 % | $E_{fc}$ Diff. | - 4.5 % |
| CO Diff. | 0.0 ppm | Pr Diff. | 1.016 $in_{WC}$ |
| $CO_c$ Diff. | 0.0 ppm | EA Diff. | - 1384 % |
| $D_{pt}$ Diff. | 29.6 °F | GI Diff. | 0.0 |
| $NO_X$ Diff. | 22 ppm | $NO_{Xc}$ Diff. | - 32 ppm |
| NO Diff. | 22 ppm | $NO_c$ Diff. | - 32 ppm |
| $NO_2$ Diff. | 0 ppm | $NO_{2c}$ Diff. | 0 ppm |
| $SO_2$ Diff. | 106 ppm | $SO_{2c}$ Diff. | - 18 ppm |
| $C_{on}$ Diff. | 0 lbs/lb | | |

Fig. 5

| Table 6: Vehicle emission results from an automobile with 93 octane fuel without a fuel additive. | | | |
|---|---|---|---|
| $O_2$ | 0.0 % | $T_A$ | 72.8 °F |
| $CO_2$ | 15.4 % | $T_S$ | 128.4 °F |
| SL | 7.1% | $E_{fc}$ | 92.9 % |
| CO | 1.0 ppm | Pr | - 0.025 $in_{WC}$ |
| $CO_c$ | 1.0 ppm | EA | 0.0 % |
| $D_{pt}$ | 124.8 °F | GI | 0.0 |
| $NO_X$ | 12 ppm | $NO_{Xc}$ | 12 ppm |

Fig. 6

| Table 7: Vehicle emission results from an automobile with 93 octane fuel without a fuel additive. | | | |
|---|---|---|---|
| $CO_c$ | 0.0 ppm | EA | 0.0 % |
| $D_{pt}$ | 124.8 °F | GI | 0.0 |
| $NO_X$ | 12 ppm | $NO_{Xc}$ | 12 ppm |
| NO | 0.0 ppm | $NO_c$ | 0.0 ppm |
| $NO_2$ | 12 ppm | $NO_{2c}$ | 12 ppm |
| $SO_2$ | 0.0 ppm | $SO_{2c}$ | 0.0 ppm |
| $CO_{on}$ | 0.0 lbs/lb | | |

Fig. 7

| Table 8: Vehicle emission results from an automobile with 93 octane fuel with a fuel additive. | | | |
|---|---|---|---|
| $O_2$ | 12.9 % | $T_A$ | 90.6 °F |
| $CO_2$ | 5.9 % | $T_S$ | 204.8 °F |
| SL | 11.5 % | $E_{fc}$ | 88.5 % |
| CO | 19 ppm | Pr | 0.0 $in_{WC}$ |
| $CO_c$ | 49 ppm | EA | 159 % |
| $D_{pt}$ | 104.7 °F | GI | 0.0003 |
| $NO_X$ | 1.0 ppm | $NO_{Xc}$ | 3.0 ppm |

Fig. 8

| Table 9: Vehicle emission results from an automobile with 93 octane fuel with a fuel additive. | | | |
|---|---|---|---|
| $CO_c$ | 50 ppm | EA | 163 % |
| $D_{pt}$ | 104.5 °F | GI | 0.0003 |
| $NO_X$ | 1.0 ppm | $NO_{Xc}$ | 3.0 ppm |
| NO | 1.0 ppm | $NO_c$ | 3.0 ppm |
| $NO_2$ | 0.0 ppm | $NO_{2c}$ | 0.0 ppm |
| $SO_2$ | 0.0 ppm | $SO_{2c}$ | 0.0 ppm |
| $C_{on}$ | 0.0 lbs/lb | | |

Fig. 9

| Table 10: Vehicle emission results comparison from an automobile with 93 octane fuel without vs. with a fuel additive. | | | |
|---|---|---|---|
| $O_2$ Diff. | - 12.9 % | $T_A$ Diff. | - 17.8 °F |
| $CO_2$ Diff. | 9.5 % | $T_S$ Diff. | - 76.4 °F |
| SL Diff. | - 4.4 % | $E_{fc}$ Diff. | 4.4 % |
| CO Diff. | - 18 ppm | Pr Diff. | 1.016 $in_{WC}$ |
| $CO_c$ Diff. | - 49 ppm | EA Diff. | - 159 % |
| $D_{pt}$ Diff. | 20.1 °F | GI Diff. | - 0.003 |
| $NO_X$ Diff. | 11 ppm | $NO_{Xc}$ Diff. | 9 ppm |
| NO Diff. | - 1 ppm | $NO_c$ Diff. | - 3 ppm |
| $NO_2$ Diff. | 12 ppm | $NO_{2c}$ Diff. | 12 ppm |
| $SO_2$ Diff. | 0 ppm | $SO_{2c}$ Diff. | 0 ppm |
| $C_{on}$ Diff. | 0 lbs/lb | | |

Fig. 10

FUEL ADDITIVE COMPOSITION

CROSS-REFERENCE TO RELATED APPLICATIONS

This application claims priority to and the benefit of the filing of U.S. Provisional Patent Application No. 63/412,725, entitled "FUEL ADDITIVE COMPOSITION", filed on Oct. 3, 2022, and the specification thereof is incorporated herein by reference.

BACKGROUND OF THE INVENTION

Field of the Invention (Technical Field)

Embodiments of the present invention relate to a composition for and method of making a fuel additive.

Description of Related Art

Fuels, including gasoline and diesel, are currently used to power vehicles and/or equipment, including cars, trucks, vans, motorcycles, and motorbikes with internal combustion engines. Internal combustion engines combust fuel to produce mechanical force and the subsequent propulsion of vehicles. The combustion of fuel breaks it down into simpler molecules including CO, $CO_2$, NO, $NO_2$, and sulfur compounds. Many of these simpler molecules are atmospheric pollutants. What is needed is a way to prevent, inhibit, or otherwise reduce the formation of these compounds after fuel combustion.

BRIEF SUMMARY OF THE INVENTION

Embodiments of the present invention are directed to a composition for a fuel additive, the composition comprising: an anthocyanidin; an amino acid; and a catalyst. In another embodiment, the anthocyanidin comprises delphinidin chloride. In another embodiment, the amino acid comprises aspartic acid. In another embodiment, the amino acid comprises leucine acid. In another embodiment, the amino acid comprises glutamic acid. In another embodiment, the amino acid comprises a non-natural amino acid.

In another embodiment, the catalyst comprises catalase enzyme. In another embodiment, the catalyst comprises glucosidase. In another embodiment, the composition further comprises a neutral-pH enzyme. In another embodiment, the composition further comprises ethanol. In another embodiment, the composition further comprises an acid. In another embodiment, the acid comprises an organic acid. In another embodiment, the acid comprises a weak acid. In another embodiment, the composition is at a pH of less than 7.

The present invention also relates to a method for making a fuel additive, the method comprising: providing an anthocyanidin; contacting the anthocyanidin with an amino acid to form an anthocyanidin-amino acid mixture; contacting the anthocyanidin-amino acid mixture with a catalyst. In another embodiment, the method further comprises contacting the anthocyanidin-amino acid mixture with ethanol. In another embodiment, the method further comprises contacting the anthocyanidin-amino acid mixture with an acid. In another embodiment, the method further comprises adjusting the pH of the anthocyanidin-amino acid mixture to less than 7. In another embodiment, the anthocyanidin comprises delphinidin chloride. In another embodiment, the catalyst comprises catalase.

Further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more embodiments of the invention and are not to be construed as limiting the invention. In the drawings:

FIG. 1 is a table showing vehicle emission results from an all-terrain vehicle with 87 octane fuel without the fuel additive of the present invention;

FIG. 2 is a table showing vehicle emission results from an all-terrain vehicle with 87 octane fuel without the fuel additive of the present invention;

FIG. 3 is a table showing vehicle emission results from an all-terrain vehicle with 87 octane fuel with an embodiment of the fuel additive of the present invention;

FIG. 4 is a table showing vehicle emission results from an all-terrain vehicle with 87 octane fuel with an embodiment of the fuel additive of the present invention;

FIG. 5 is a table showing the difference in vehicle emission results between an all-terrain vehicle with 87 octane fuel without and with an embodiment of the fuel additive of the present invention;

FIG. 6 is a table showing vehicle emission results from an automobile with 93 octane fuel without the fuel additive of the present invention;

FIG. 7 is a table showing vehicle emission results from an automobile with 93 octane fuel without the fuel additive of the present invention;

FIG. 8 is a table showing vehicle emission results from an automobile with 93 octane fuel with an embodiment of the fuel additive of the present invention;

FIG. 9 is a table showing vehicle emission results from an automobile with 93 octane fuel with an embodiment of the fuel additive of the present invention; and FIG. 10 is a table showing the difference in vehicle emission results between an automobile with 93 octane fuel without and with an embodiment of the fuel additive of the present invention.

DETAILED DESCRIPTION OF THE INVENTION

Embodiments of the present invention generally relate to a fuel additive composition comprising: an anthocyanidin; an amino acid; and a catalyst. The anthocyanidin may comprise delphinidin chloride. The amino acid may comprise aspartic acid, leucine acid, or a combination thereof. The catalyst may comprise catalase enzyme. The fuel additive composition may further comprise an organic acid.

The term "fuel" is defined in the specification and drawings as a compound capable of combusting within a chamber and includes, but is not limited to, gasoline, diesel, jet fuel, octane, heptane, pentane, butane, propane, methane, ethanol, or a combination thereof.

As used throughout this application, the term "additive" means one or more compounds or compositions that improves fuel by means including, but not limited to, reducing fuel emissions following fuel combustion, increase fuel efficiency, reducing fuel combustion cost, reducing pre-combustion pollutants and/or impurities, or a combination thereof.

Throughout this application, abbreviations are provided for the combustion metrics of an embodiment of the fuel additive of the present invention. The combustion metric and their associated abbreviations are shown in Table A below.

TABLE A

Combustion metrics and associated abbreviations for an embodiment of a fuel additive of the present invention.

| Metric | Abbreviation |
|---|---|
| $O_2$ | oxygen concentration in flue gas |
| CO | carbon monoxide in flue gas |
| $CO_2$ | carbon dioxide concentration in flue gas[1] |
| $CO_c$ | carbon monoxide, air free (corrected)[2] |
| NO | nitric oxide concentration in flue gas |
| $NO_2$ | nitrogen dioxide concentration in flue gas |
| $NO_c$ | nitric oxide, air free (corrected); default of 0% (oil and gas) |
| $NO_{2c}$ | nitrogen dioxide, air free (corrected)[2] |
| $NO_X$ | nitric oxide plus nitrogen dioxide concentration in flue gas |
| $NO_{Xc}$ | nitric oxide plus nitrogen dioxide, air free (corrected); default of 0% (oil and gas) |
| $SO_2$ | sulfur dioxide in flue gas |
| $SO_{2c}$ | sulfur dioxide, air free (corrected)[2] |
| SL | efficiency and losses[3] |
| $D_{pt}$ | dew point in the flue gas[4] |
| $T_A$ | combustion air temperature |
| $T_S$ | flue gas temperature |
| $E_{fc}$ | excess air coefficient[5] |
| Pr | differential pressure |
| EA | excess air |
| GI | toxication index[6] |
| $C_{on}$ | condensate quality in condensing conditions |

[1]measured according to the nondispersive infrared ("NDIR") gas detection measurement principle
[2]where the default amount is 0% in a mixture of oil and gas
[3]measured in accordance to American Society of Mechanical Engineer ("ASME") standards
[4]measured in Celsius
[5]represented as lambda, e.g., 1.25 when the excess of air is 25%
[6]measured as a ratio of $CO/CO_2$ Throughout the application, abbreviations are provided for physical and/or chemical parameters and/or tests performed under ASTM International standards. The ASTM international standards referenced herein are incorporated by reference. The abbreviations and their associated parameters and/or tests are shown in Table B below.

TABLE B

Abbreviations and their associated parameters and/or tests for the combustion of fuel.

| Abbreviation | Parameter and/or Test |
|---|---|
| RVP | the vapor pressure at 100° F. of a product determined in a volume of air four times the liquid volume |
| Hazy | whether the sample shows a haze when cooled under the ASTM standard |
| Phase Separation | whether phase separation occurred under the ASTM standard |

TABLE B-continued

Abbreviations and their associated parameters and/or tests for the combustion of fuel.

| Abbreviation | Parameter and/or Test |
|---|---|
| Copper | ASTM standard test method for corrosiveness to copper from petroleum products by copper strip test |
| Duration | Duration of ASTM standard test method for corrosiveness to copper from petroleum products by copper strip test |
| Temperature | Temperature of ASTM standard test method for corrosiveness to copper from petroleum products by copper strip test |
| BTUHeat | British Thermal Units of Heat under the ASTM standard test method for heat of combustion of liquid hydrocarbon fuels by bomb calorimeter |
| MJHeat | Mega Joules of Heat under the ASTM standard test method for heat of combustion of liquid hydrocarbon fuels by bomb calorimeter |
| CALHeat | Calories of Heat under the ASTM standard test method for heat of combustion of liquid hydrocarbon fuels by bomb calorimeter |
| RON | Research Octane Number under the ASTM standard test method for research octane number of spark-ignition engine fuel |
| MON | Motor Octane Number under the ASTM standard test method for research octane number of spark-ignition engine fuel |
| Lead | The amount of trace lead as required by federal regulation for lead-free gasoline (40 code of federal regulations, part 80) |
| Hydrogen | Determination of the hydrogen content in petroleum liquids |
| UnWashdGm | Determination of the existent gum content of aviation fuels, and the gum content of motor gasolines or other volatile distillates in their finished form, (including those containing alcohol and ether type oxygenates and deposit control additives) at the time of the test |
| WashdGum | Determination of the existent gum content of aviation fuels, and the gum content of motor gasolines or other volatile distillates in their finished form, (including those containing alcohol and ether type oxygenates and deposit control additives) at the time of the test. For this test the sample is washed with heptane |
| Manganese | Manganese content under the ASTM standard test method for manganese in gasoline by atomic absorption spectroscopy |
| API at 60° F. | American Petroleum Institute ("API") gravity under the ASTM standard test method for density, relative density, and API gravity of liquids by digital density meter at 60° F. |
| SPGr at 60° F. | Specific gravity under the ASTM standard test method for density, relative density, and API gravity of liquids by digital density meter at 60° F. |
| Density at 15° C. | Density under the ASTM standard test method for density, relative density, and API gravity of liquids by digital density meter at 15° C. |
| V/L = 20 | Vapor to liquid ratio of 20:1; determination of the temperature at which the vapor formed from a selected volume of volatile petroleum product saturated with air at 32° F. to 34° F. produces a pressure of 101.3 kPa (one atmosphere) against vacuum under the ASTM Standard Test Method for Vapor-Liquid Ratio Temperature Determination of Fuels (Evacuated Chamber and Piston Based Method) |

TABLE B-continued

Abbreviations and their associated parameters and/or tests for the combustion of fuel.

| Abbreviation | Parameter and/or Test |
|---|---|
| V/L = 20 deg C. | Vapor to liquid ratio of 20:1; determination of the temperature at which the vapor formed from a selected volume of volatile petroleum product saturated with air at 0° C. to 1° C. produces a pressure of 101.3 kPa (one atmosphere) against vacuum under the ASTM Standard Test Method for Vapor-Liquid Ratio Temperature Determination of Fuels (Evacuated Chamber and Piston Based Method) |
| RunTime | The run time under the ASTM standard test method for oxidation stability of gasoline (induction period method) |
| BreakY/N | Whether a break occurs under the ASTM standard test method for oxidation stability of gasoline (induction period method) |
| BreakPt | The break point under the ASTM standard test method for oxidation stability of gasoline (induction period method) |
| MaxPsi | The maximum pounds per square inch under the ASTM standard test method for oxidation stability of gasoline (induction period method) |
| MaxTime | The maximum time under the ASTM standard test method for oxidation stability of gasoline (induction period method) |
| MinPsi | The minimum pounds per square inch under the ASTM standard test method for oxidation stability of gasoline (induction period method) |
| MinTime | The minimum time under the ASTM standard test method for oxidation stability of gasoline (induction period method) |
| psiDrop | The pounds per square inch drop under the ASTM standard test method for oxidation stability of gasoline (induction period method) |
| Sulfur | The determination of total sulfur in liquid hydrocarbons under the ASTM Standard Test Method for Determination of Total Sulfur in Light Hydrocarbons, Spark Ignition Engine Fuel, Diesel Engine Fuel, and Engine Oil by Ultraviolet Fluorescence |
| SulfurWtPct | The determination of total sulfur as a weight percentage in liquid hydrocarbons under the ASTM Standard Test Method for Determination of Total Sulfur in Light Hydrocarbons, Spark Ignition Engine Fuel, Diesel Engine Fuel, and Engine Oil by Ultraviolet Fluorescence |
| DIPEVol | Quantity of diisopropyl ether ("DIPE") by volume under the ASTM standard test method for determination of oxygenates in gasoline by gas chromatography and oxygen selective flame ionization detection |
| DIPEWt | Quantity of diisopropyl ether ("DIPE") by weight under the ASTM standard test method for determination of oxygenates in gasoline by gas chromatography and oxygen selective flame ionization detection |
| ETBEVol | Quantity of ethyl tert-butyl ether ("ETBE") by volume under the ASTM standard test method for determination of oxygenates in gasoline by gas chromatography and oxygen selective flame ionization detection |
| ETBEWt | Quantity of ethyl tert-butyl ether ("ETBE") by weight under the ASTM standard test method for determination of oxygenates in gasoline by gas chromatography and oxygen selective flame ionization detection |
| EtOHVol | Quantity of ethanol ("EtOH") by volume under the ASTM standard test method for determination of oxygenates in gasoline by gas chromatography and oxygen selective flame ionization detection |

TABLE B-continued

Abbreviations and their associated parameters and/or tests for the combustion of fuel.

| Abbreviation | Parameter and/or Test |
|---|---|
| EtOHWt | Quantity of ethanol ("EtOH") by weight under the ASTM standard test method for determination of oxygenates in gasoline by gas chromatography and oxygen selective flame ionization detection |
| iBAVol | Quantity of indole-3-butyric acid ("iBA") by volume under the ASTM standard test method for determination of oxygenates in gasoline by gas chromatography and oxygen selective flame ionization detection |
| IBAWt | Quantity of indole-3-butyric acid ("iBA") by weight under the ASTM standard test method for determination of oxygenates in gasoline by gas chromatography and oxygen selective flame ionization detection |
| IPAVol | Quantity of isopropyl alcohol ("iPA") by volume under the ASTM standard test method for determination of oxygenates in gasoline by gas chromatography and oxygen selective flame ionization detection |
| IPAWt | Quantity of isopropyl alcohol ("iPA") by weight under the ASTM standard test method for determination of oxygenates in gasoline by gas chromatography and oxygen selective flame ionization detection |
| MeOHVol | Quantity of methanol ("MeOH") by volume under the ASTM standard test method for determination of oxygenates in gasoline by gas chromatography and oxygen selective flame ionization detection |
| MeOHWt | Quantity of methanol ("MeOH") by weight under the ASTM standard test method for determination of oxygenates in gasoline by gas chromatography and oxygen selective flame ionization detection |
| MTBEVol | Quantity of methyl tert-butyl ether ("MTBE") by volume under the ASTM standard test method for determination of oxygenates in gasoline by gas chromatography and oxygen selective flame ionization detection |
| MTBEWt | Quantity of methyl tert-butyl ether ("MTBE") by weight under the ASTM standard test method for determination of oxygenates in gasoline by gas chromatography and oxygen selective flame ionization detection |
| nBAVol | Quantity of n-butyl acetate ("nBA") by volume under the ASTM standard test method for determination of oxygenates in gasoline by gas chromatography and oxygen selective flame ionization detection |
| nBAWt | Quantity of n-butyl alcohol ("nBA") by weight under the ASTM standard test method for determination of oxygenates in gasoline by gas chromatography and oxygen selective flame ionization detection |
| nPAVol | Quantity of n-propyl alcohol ("nPA") by volume under the ASTM standard test method for determination of oxygenates in gasoline by gas chromatography and oxygen selective flame ionization detection |
| nPAWt | Quantity of n-propyl alcohol ("nPA") by weight under the ASTM standard test method for determination of oxygenates in gasoline by gas chromatography and oxygen selective flame ionization detection |
| sBAVol | Quantity of secondary butyl alcohol ("nBA") by volume under the ASTM standard test method for determination of oxygenates in gasoline by gas chromatography and oxygen selective flame ionization detection |
| SBAWt | Quantity of secondary butyl alcohol ("nBA") by weight under the ASTM standard test method for determination of oxygenates in gasoline by gas chromatography and oxygen selective flame ionization detection |

TABLE B-continued

Abbreviations and their associated parameters and/or tests for the combustion of fuel.

| Abbreviation | Parameter and/or Test |
|---|---|
| TAMEVol | Quantity of tert-amyl methyl ether ("TAME") by volume under the ASTM standard test method for determination of oxygenates in gasoline by gas chromatography and oxygen selective flame ionization detection |
| TAMEWt | Quantity of tert-amyl methyl ether ("TAME") by weight under the ASTM standard test method for determination of oxygenates in gasoline by gas chromatography and oxygen selective flame ionization detection |
| tBAVol | Quantity of tertiary butyl alcohol ("TBA") by volume under the ASTM standard test method for determination of oxygenates in gasoline by gas chromatography and oxygen selective flame ionization detection |
| tBAWt | Quantity of tertiary butyl alcohol ("TBA") by weight under the ASTM standard test method for determination of oxygenates in gasoline by gas chromatography and oxygen selective flame ionization detection |
| tPAVol | Quantity of terephthalic acid ("tPA") by volume under the ASTM standard test method for determination of oxygenates in gasoline by gas chromatography and oxygen selective flame ionization detection |
| tPAWt | Quantity of terephthalic acid ("tPA") by weight under the ASTM standard test method for determination of oxygenates in gasoline by gas chromatography and oxygen selective flame ionization detection |
| TtlWt | Total weight ("TtlWt") percentage of oxygenates under the ASTM standard test method for determination of oxygenates in gasoline by gas chromatography and oxygen selective flame ionization detection |
| Rating | The determination of the corrosiveness to silver by automotive spark-ignition engine fuel under the ASTM standard test method for corrosiveness to silver by automotive spark-ignition engine fuel-silver strip method |
| IBP | The initial boiling point ("IBP") under the ASTM standard test method for distillation of petroleum products and liquid fuels at atmospheric pressure |
| Evap_5 | The evaporation point at 5° F. ("Evap_5") under the ASTM standard test method for distillation of petroleum products and liquid fuels at atmospheric pressure |
| Evap_10 | The evaporation point at 10° F. ("Evap_10") under the ASTM standard test method for distillation of petroleum products and liquid fuels at atmospheric pressure |
| Evap_15 | The evaporation point at 15° F. ("Evap_15") under the ASTM standard test method for distillation of petroleum products and liquid fuels at atmospheric pressure |
| Evap_20 | The evaporation point at 20° F. ("Evap_20") under the ASTM standard test method for distillation of petroleum products and liquid fuels at atmospheric pressure |
| Evap_30 | The evaporation point at 30° F. ("Evap_30") under the ASTM standard test method for distillation of petroleum products and liquid fuels at atmospheric pressure |
| Evap_40 | The evaporation point at 40° F. ("Evap_40") under the ASTM standard test method for distillation of petroleum products and liquid fuels at atmospheric pressure |
| Evap_50 | The evaporation point at 50° F. ("Evap_50") under the ASTM standard test method for distillation of petroleum products and liquid fuels at atmospheric pressure |

TABLE B-continued

Abbreviations and their associated parameters and/or tests for the combustion of fuel.

| Abbreviation | Parameter and/or Test |
|---|---|
| Evap_60 | The evaporation point at 60° F. ("Evap_60") under the ASTM standard test method for distillation of petroleum products and liquid fuels at atmospheric pressure |
| Evap_70 | The evaporation point at 70° F. ("Evap_70") under the ASTM standard test method for distillation of petroleum products and liquid fuels at atmospheric pressure |
| Evap_80 | The evaporation point at 80° F. ("Evap_80") under the ASTM standard test method for distillation of petroleum products and liquid fuels at atmospheric pressure |
| Evap_90 | The evaporation point at 90° F. ("Evap_90") under the ASTM standard test method for distillation of petroleum products and liquid fuels at atmospheric pressure |
| Evap_95 | The evaporation point at 95° F. ("Evap_95") under the ASTM standard test method for distillation of petroleum products and liquid fuels at atmospheric pressure |
| FBP | Final boiling point ("FBP") under the ASTM standard test method for distillation of petroleum products and liquid fuels at atmospheric pressure |
| Recovered | Fuel recovery under the ASTM standard test method for distillation of petroleum products and liquid fuels at atmospheric pressure |
| Residue | Fuel residue under the ASTM standard test method for distillation of petroleum products and liquid fuels at atmospheric pressure |
| Loss | Fuel loss under the ASTM standard test method for distillation of petroleum products and liquid fuels at atmospheric pressure |

Throughout the application, abbreviations are provided for physical and/or chemical parameters and/or tests performed under ASTM International standards. The ASTM international standards referenced herein are incorporated by reference. The units and their abbreviations are shown in Table C below.

TABLE C

Units and their associated abbreviations.

| Unit | Abbreviation |
|---|---|
| pounds per square inch | psi |
| hours | hrs |
| degrees Celsius | deg C |
| British thermal unit per pound | BTU/lb |
| megajoules per kilogram | MJ/kg |
| calories per gram | cal/g |
| gram per gallon | g/gal |
| mass percentage | mass % |
| milligrams per 100 milliliter | mg/100 mL |
| milligrams per liter | mg/l |
| grams per milliliter | g/ml |
| degrees Fahrenheit | deg F. |
| minimum | min |
| maximum | max |
| parts per million | ppm |
| percent | % |
| volume percent | Vol % |
| weight percent | Wt % |

Turning now to the figures, FIG. 1, FIG. 2, FIG. 3, FIG. 4, and FIG. 5 show the results tables of vehicle emission tests in an all-terrain vehicle with 87 octane fuel with and without a fuel additive. Specifically, FIGS. 1 and 2 show vehicle emission results from an all-terrain vehicle with 87 octane fuel without a fuel additive. FIGS. 3 and 4 show vehicle emission results from an all-terrain vehicle with 87 octane fuel with a fuel additive. FIG. 5 shows the difference in values between vehicle emission results from an all-terrain vehicle with 87 octane fuel without a fuel additive and with a fuel additive, with the values from FIGS. 3 and 4 subtracted from the values of FIGS. 1 and 2. Repeated measurements are averaged. Table 5 shows improved $O_2$ emissions, decreased $CO_2$ emissions, and decreased nitrogen compound emissions in an all-terrain vehicle with 87 octane fuel with additive relative to an all-terrain vehicle with 87 octane fuel without additive FIG. 6, FIG. 7, FIG. 8, FIG. 9, and FIG. 10 show the results tables of vehicle emission tests in an automobile with 93 octane fuel with and without a fuel additive. Specifically, FIGS. 6 and 7 show vehicle emission results from an automobile with 93 octane fuel without a fuel additive. FIGS. 8 and 9 show vehicle emission results from an automobile with 93 octane fuel with a fuel additive. FIG. 10 shows the difference in values between vehicle emission results from an automobile with 93 octane fuel without a fuel additive and with a fuel additive, with the values from FIGS. 8 and 9 subtracted from the values of FIGS. 6 and 7. Repeated measurements are averaged. Table 10 shows improved $O_2$ emissions, decreased $CO_2$ emissions, and decreased nitrogen compound emissions in an automobile with 93 octane fuel with additive relative to an automobile with 93 octane fuel without additive The fuel additive composition may alter and/or weaken bonding between fuel molecules. The altered and/or weakened bonding in fuel molecules may cause improved breakdown of these molecules during combustion. Thus, vehicles and/or equipment using fuel contacted with fuel additive composition may achieve greater fuel mileage and/or run time than without fuel additive composition. Contacting the fuel additive composition with fuel may preserve the combustive efficacy of the fuel.

The fuel additive composition may be added to fuel of any octane and/or fuel comprising a hydrocarbon chain of any number of carbon atoms. The fuel additive composition may or may not comprise ethanol. The contacting fuel with fuel additive composition may alter, decompose, or remove the bonding capability required by carbon, nitric, oxygen, and sulfur to form air pollutants.

The fuel additive composition may comprise an anthocyanidin. The anthocyanidin may be at a concentration of at least about 0.001% to about 1.0%, about 0.005% to about 0.5%, about 0.01% to about 0.1%, or about 1.0% by weight. The anthocyanidin may include, but is not limited to delphinidin chloride, cyanidin, delphinidin, pelargonidin, peonidin, petunidin, malvidin, or a combination thereof.

The fuel additive composition may comprise an acid. The acid may be at a concentration of at least about 0.001% to about 1.0%, about 0.005% to about 0.5%, about 0.01% to about 0.1%, or about 1.0% by weight. The acid may comprise a weak acid, organic acid, diacid chloride, or a combination thereof.

The fuel additive composition may comprise an amino acid. The amino acid may be at a concentration of at least about 35% to about 65%, about 40% to about 60%, about 45% to about 55%, or about 65% by weight. The amino acid may comprise any natural or non-natural amino acid. The amino acid may comprise an acidic amino acid including, but not limited to, aspartic acid, glutamic acid, or a combination thereof. The amino acid may also comprise an aliphatic amino acid including, but not limited to, alanine, glycine, isoleucine, leucine, proline, valine, or a combination thereof. The at least one fuel additive may also comprise a neutral-pH enzyme. The neutral-pH enzyme may include, but is not limited to, arginine, histidine, glutamate, or a combination thereof.

The fuel additive composition may comprise a catalyst. The catalyst may be at a concentration of at least about 0.001% to about 1.0%, about 0.005% to about 0.5%, about 0.01% to about 0.1%, or about 1.0% by weight. The catalyst may comprise an enzyme. The enzyme may include, but is not limited to, catalase, glucosidase, amylase, lipase, or a combination thereof.

The fuel additive composition may comprise and aqueous solution. The fuel additive composition may comprise a pH of less than 7. The fuel additive composition may also comprise a solid, for example, a powder.

The fuel additive composition may comprise a ratio of anthocyanidin to amino acid of at least about 1:500 to about 1:1750, about 1:750 to about 1:1500, about 1:1000 to about 1:1250, or about 1:1750.

The fuel additive composition may increase the emission of 02 from combusted fuel compared to fuel without the fuel additive composition. The 02 emission may be increased by at least about 500% to about 1000%, about 600% to about 900%, about 700% to about 800%, or about 1000%.

The fuel additive composition may decrease the emission of $CO_2$ from combusted fuel compared to fuel without the fuel additive composition. The $CO_2$ emission may be decreased by at least about 75% to about 99%, about 85% to about 97%, about 90% to about 95%, or about 99%.

The fuel additive composition may decrease the emission of $NO_x$ from combusted fuel compared to fuel without the fuel additive composition. The $NO_x$ emission may be decreased by at least about 80% to about 99%, about 85% to about 97%, about 90% to about 95%, or about 99%.

The fuel additive composition may decrease the emission of $SO_2$ from combusted fuel compared to fuel without the fuel additive composition. The $SO_2$ emission may be decreased by at least about 80% to about 99%, about 85% to about 97%, about 90% to about 95%, or about 99%.

The fuel additive composition may decrease the quantity of $NO_x$ in fuel prior to use in a combustion engine compared to fuel without the fuel additive composition. The decrease in quantity of $NO_x$ may be at least about 50% to about 75%, about 55% to about 70%, about 60% to about 65%, or about 75%.

The fuel additive composition may comprise ethanol. Ethanol may have a synergistic effect with the fuel additive composition in a solution and/or liquid comprising fuel additive composition, fuel, and ethanol. The fuel additive composition may further reduce quantity of an $NO_x$ molecule in fuel with ethanol compared to the $NO_x$ molecule reduction in fuel without ethanol. The reduction in $NO_x$ molecule fuel with ethanol is at least about 1.0% to about 10.0%, about 2.0% to about 9.0%, about 3.0% to about 8.0%, about 4.0% to about 7.0%, about 5.0% to about 6.0%, or about 10.0% greater compared to fuel without ethanol.

The fuel additive composition may be used in a stationary combustion engine. The stationary combustion engine may include, but is not limited to, a generator, power station, turbine, or a combination thereof.

The fuel additive composition may be used in the combustion engine of a vehicle. The vehicle may include, but is not limited to, an automobile, train, aircraft, watercraft, drone, rover, rocket, off-road vehicle, farm equipment, construction equipment, any device or apparatus comprising an internal combustion engine, or a combination thereof.

The fuel additive composition may decrease a vehicle's idle speed. The diesel speed may be decreased by at least about 1.0% to about 10.0%, about 2.0% to about 9.0%, about 3.0% to about 8.0%, about 4.0% to about 7.0%, about 5.0% to about 6.0%, or about 10.0%.

The fuel additive composition may improve a vehicle's gas mileage. The gas mileage may be improved by at least about 1.0% to about 5.0%, about 1.5% to about 4.5%, about 2.0% to about 4.0%, about 2.5% to about 3.5%, or about 5.0%.

The fuel additive composition may increase a vehicle's run time in a non-catalytic converter single stroke engine. The run time may be increased by at least about 1.0% to about 5.0%, about 1.5% to about 4.5%, about 2.0% to about 4.0%, about 2.5% to about 3.5%, or about 5.0%.

The fuel additive may comply with the ASTM D4814 standard and or the D975 diesel standard. The ASTM D4814 standard covers the establishment of requirements of liquid automotive fuels for ground vehicles equipped with spark-ignition engines. This standard describes various characteristics of automotive fuels for use over a wide range of operating conditions.

Embodiments of the present invention provide a technology-based solution that overcomes existing problems with the current state of the art in a technical way to satisfy an existing problem for reducing the environmental impact of combusted fuels. Embodiments of the present invention achieve important benefits over the current state of the art, such as increased fuel efficiency and decreased emissions from fuel combustion. Some of the unconventional elements of embodiments of the present invention include a fuel additive composed of diacid chloride, an enzyme, an amino acid.

INDUSTRIAL APPLICABILITY

The invention is further illustrated by the following non-limiting examples.

Example 1

2.2 grams of the fuel additive composition was combined with 26 gallons of gasoline. The fuel was used in the combustion engine of a commercial automobile and the automobile was driven for a distance of 30 miles. Tests were performed to evaluate the emissions from the automobile.

Example 2

Gasoline without fuel additive composition was compared with gasoline with fuel additive to confirm that the addition of the fuel additive composition did not change the chemical identity of the gasoline. The results are shown in Table D below. Table D: Chemical evaluation of base gasoline v. treated gasoline.

| ASTM Standard | Measurement | Unit | Base Gasoline: 92 Octane No Ethanol No Additive | Treated Gasoline: 92 Octane No Ethanol With Additive | D4814 Specification |
|---|---|---|---|---|---|
| D5191 | RVP | psi | 10.96 | 11.19 | Class C −11.5 |
| D5191 | Hazy | | NO | NO | |
| D5191 | Phase Separation | | NO | NO | |
| D130 Fuels | Copper | | 1A | 1A | 1 |
| D130 Fuels | Duration | hrs | 3.0 | 3.0 | |
| D130 Fuels | Temperature | deg C. | 50 | 50 | |
| D240G | BTUHeat | BTU/lb | 19424 | 19378 | |
| D240G | MJHeat | MJ/kg | 45.180 | 45.073 | |
| D240G | CALHeat | cal/g | 10791.1 | 10765.6 | |
| D240N | BTUHeat | BTU/lb | 18172 | 18158 | |
| D240N | MJHeat | MJ/kg | 42.269 | 42.236 | |
| D240N | CALHeat | cal/g | 10095.8 | 10087.8 | |
| D2699Mdp | RON | ON | 97.2 | 97.3 | |
| D2700Mdp | MON | ON | 87.2 | 87.3 | |
| D3237 | Lead | g/gal | <0.001 | <0.001 | 0.013 max |
| D3701 | Hydrogen | mass % | 13.72 | 13.37 | |
| D381 | UnWshdGm | mg/100 mL | 13.00 | 13.50 | |
| D381 | WashdGum | mg/100 mL | <0.5 mg/100mL | <0.5 mg/100mL | 5 max |
| D3831 | Manganese | mg/l | <0.2 | <0.2 | 0.25 max |
| D4052 | SPGr at 60° F. | | 0.7417 | 0.7404 | |
| D4052 | Density at 15° C. | g/ml | 0.7415 | 0.7401 | |
| D5188 | V/L = 20 | deg F. | 128.90 | 128.00 | |
| D5188 | V/L = 20 deg C. | deg C. | 53.83 | 53.33 | 54 max |
| D5188 | Hazy | | NO | NO | |
| D5188 | Phase Separation | | NO | NO | |
| D525 | RunTime | min | 1440 | 1440 | 240 minutes |
| D525 | BreakY/N | | NO BREAK | NO BREAK | |
| D525 | BreakPt | min | N/A | N/A | |
| D525 | MaxPsi | psi | 130.2 | 148.8 | |
| D525 | MaxTime | min | 165 | 1135 | |
| D525 | MinPsi | psi | 121.8 | 148.1 | |

-continued

| ASTM Standard | Measurement | Unit | Base Gasoline: 92 Octane No Ethanol No Additive | Treated Gasoline: 92 Octane No Ethanol With Additive | D4814 Specification |
|---|---|---|---|---|---|
| D525 | MinTime | min | 1439 | 324 | |
| D525 | psiDrop | psi | 8.4 | 0.7 | |
| D5453 | Sulfur | ppm | 4.69 | 5.00 | 10 |
| D5453 | SulfurWtPct | % | 0.0005 | 0.0005 | |
| D5599 | DIPEVol | Vol % | <0.1 | <0.1 | |
| D5599 | DIPEWt | Wt % | <0.1 | <0.1 | |
| D5599 | ETBEVol | Vol % | 16.6735 | 16.3920 | |
| D5599 | ETBEWt | Wt % | 16.7522 | 16.4994 | |
| D5599 | EtOHVol | Vol % | <0.1 | <0.1 | |
| D5599 | EtOHWt | Wt % | <0.1 | <0.1 | |
| D5599 | IBAVol | Vol % | <0.1 | <0.1 | |
| D5599 | iBAWt | Wt % | <0.1 | <0.1 | |
| D5599 | IPAVol | Vol % | <0.1 | <0.1 | |
| D5599 | iPAWt | Wt % | <0.1 | <0.1 | |
| D5599 | MeOHVol | Vol % | <0.1 | <0.1 | |
| D5599 | MeOHWt | Wt % | <0.1 | <0.1 | |
| D5599 | MTBEVol | Vol % | <0.1 | <0.1 | |
| D5599 | MTBEWt | Wt % | <0.1 | <0.1 | |
| D5599 | nBAVol | Vol % | <0.1 | <0.1 | |
| D5599 | nBAWt | Wt % | <0.1 | <0.1 | |
| D5599 | nPAVol | Vol % | <0.1 | <0.1 | |
| D5599 | nPAWt | Wt % | <0.1 | <0.1 | |
| D5599 | sBAVol | Vol % | <0.1 | <0.1 | |
| D5599 | sBAWt | Wt % | <0.1 | <0.1 | |
| D5599 | TAMEVol | Vol % | <0.1 | <0.1 | |
| D5599 | TAMEWt | Wt % | <0.1 | <0.1 | |
| D5599 | tBAVol | Vol % | <0.1 | <0.1 | |
| D5599 | tBAWt | Wt % | <0.1 | <0.1 | |
| D5599 | tPAVol | Vol % | <0.1 | <0.1 | |
| D5599 | tPAWt | Wt % | <0.1 | <0.1 | |
| D5599 | TtlWt | Wt % | 2.62 | 2.58 | |
| D7671 | Rating | | 0 | 0 | 1 |
| D86 | IBP | deg F. | 79.6 | 81.2 | 140 max |
| D86 | Evap_5 | deg F. | 98.0 | 99.9 | |
| D86 | Evap_10 | deg F. | 113.8 | 114.5 | |
| D86 | Evap_15 | deg F. | 127.6 | 127.6 | |
| D86 | Evap_20 | deg F. | 141.3 | 142.0 | |
| D86 | Evap_30 | deg F. | 171.7 | 171.6 | |
| D86 | Evap_40 | deg F. | 194.8 | 195.1 | |
| D86 | Evap_50 | deg F. | 207.8 | 207.5 | 170-240 |
| D86 | Evap_60 | deg F. | 217.4 | 216.7 | |
| D86 | Evap_70 | deg F. | 235.9 | 235.8 | |
| D86 | Evap_80 | deg F. | 275.4 | 274.8 | |
| D86 | Evap_90 | deg F. | 320.3 | 320.8 | 365 max |
| D86 | Evap_95 | deg F. | 350.3 | 350.2 | |
| D86 | FBP | deg F. | 392.5 | 392.0 | 437 max |
| D86 | Recovered | mL | 96.8 | 97.5 | |
| D86 | Residue | mL | 1.1 | 1.0 | 2% max |
| D86 | Loss | mL | 2.1 | 1.5 | |

The preceding examples can be repeated with similar success by substituting the generically or specifically described reactants and/or operating conditions of this invention for those used in the preceding examples.

Note that in the specification and claims, "about" or "approximately" means within twenty percent (20%) of the numerical amount cited.

Although the invention has been described in detail with particular reference to these embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A composition for a fuel additive, the composition comprising:

an anthocyanidin;

an amino acid;

a catalyst; and said composition in contact with a hydrocarbon fuel in an internal combustion engine.

2. The composition of claim 1 wherein said anthocyanidin comprises delphinidin chloride.

3. The composition of claim 1 wherein said amino acid comprises aspartic acid.

4. The composition of claim 1 wherein said amino acid comprises leucine acid.

5. The composition of claim 1 wherein said amino acid comprises glutamic acid.

6. The composition of claim 1 wherein said amino acid comprises a non-natural amino acid.

7. The composition of claim 1 wherein said catalyst comprises catalase enzyme.

8. The composition of claim 1 wherein said catalyst comprises glucosidase.

9. The composition of claim 1 further comprising a neutral-pH enzyme.

10. The composition of claim 1 further comprising ethanol.

11. The composition of claim 1 further comprising an acid.

12. The composition of claim 11 wherein said acid comprises an organic acid.

13. A method for making a fuel additive, the method comprising:

providing an anthocyanidin;

contacting the anthocyanidin with an amino acid to form an anthocyanidin-amino acid mixture;

contacting the anthocyanidin-amino acid mixture with a catalyst to form a fuel additive composition; and contacting the fuel additive composition with a hydrocarbon fuel in an internal combustion engine.

14. The composition of claim 1 wherein said composition is at a pH of less than 7.

15. The composition of claim 11 wherein said acid comprises diacid chloride.

16. The method of claim 15 further comprising contacting the anthocyanidin-amino acid mixture with ethanol.

17. The method of claim 15 further comprising contacting the anthocyanidin-amino acid mixture with an acid.

18. The method of claim 15 further comprising adjusting the pH of the anthocyanidin-amino acid mixture to less than 7.

19. The method of claim 15 wherein the anthocyanidin comprises delphinidin chloride.

20. The method of claim 15 wherein the catalyst comprises catalase.

* * * * *